US005789848A

United States Patent [19]

Dworsky et al.

[11] Patent Number: 5,789,848

[45] Date of Patent: Aug. 4, 1998

[54] FIELD EMISSION DISPLAY HAVING A CATHODE REINFORCEMENT MEMBER

[75] Inventors: Lawrence N. Dworsky, Scottsdale, Ariz.; Dean Barker, Thousand Oaks, Calif.; James E. Jaskie, Scottsdale; Ronald O. Petersen, Phoenix, both of Ariz.; Robert T. Smith, Tempe, Ariz.

[73] Assignee: Motorola, Inc., Schaumburg, Ill.

[21] Appl. No.: 691,763

[22] Filed: Aug. 2, 1996

[51] Int. Cl.[6] ..... H01J 1/30

[52] U.S. Cl. ..... 313/310; 313/495; 313/292

[58] Field of Search ..... 313/309, 310, 313/336, 351, 495, 281, 282, 292, 288

[56] References Cited

U.S. PATENT DOCUMENTS

| | | | |
|---|---|---|---|
| 5,223,766 | 6/1993 | Nakayama et al. | 313/495 |
| 5,504,385 | 4/1996 | Jin et al. | 313/309 |
| 5,561,343 | 10/1996 | Lowe | 313/496 |
| 5,614,781 | 3/1997 | Spindt et al. | 313/292 |
| 5,633,560 | 5/1997 | Huang | 313/309 |

*Primary Examiner*—Sandra L. O'Shea
*Assistant Examiner*—Joseph Williams
*Attorney, Agent, or Firm*—Kathleen Anne Tobin; Eugene A. Parsons

[57] ABSTRACT

A field emission display (100, 200, 300) and a method of making the same are disclosed. The field emission display (100, 200, 300) includes an anode (110, 210, 310) having a plurality of cathodoluminescent deposits (120, 220, 320), a back plate (185, 285, 385) including a cathode (130, 230, 330) having a plurality of field emitters (140, 240, 340) and being affixed to a cathode reinforcement member (170, 270, 370), and a plurality of side members (150, 250, 350) disposed between the anode (110, 210, 310) and the cathode (130, 230,330) and hermetically affixed thereto. The thicknesses of the anode (110, 210, 310) and the back plate (185, 285, 385) are sufficient to provide the structural support necessary to maintain the mechanical integrity of the field emission display (100, 200, 300).

2 Claims, 1 Drawing Sheet

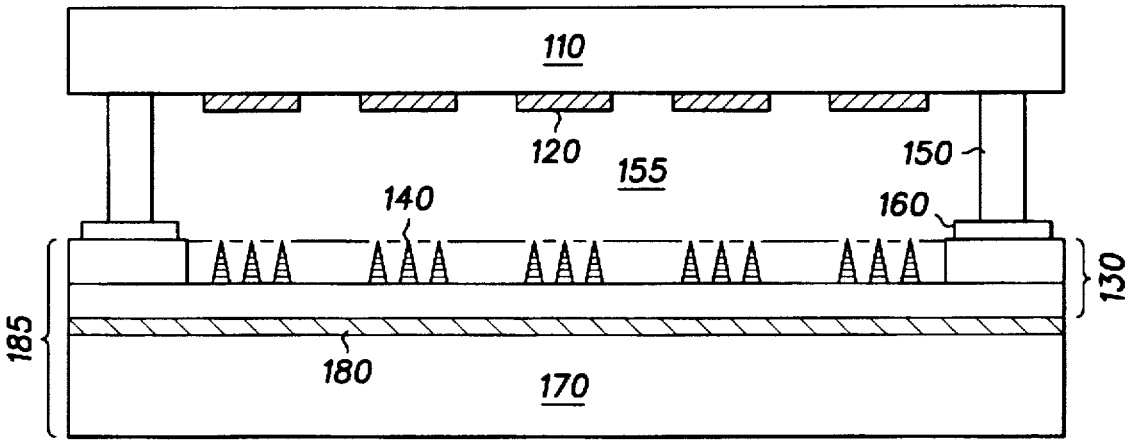
100 FIG. 1
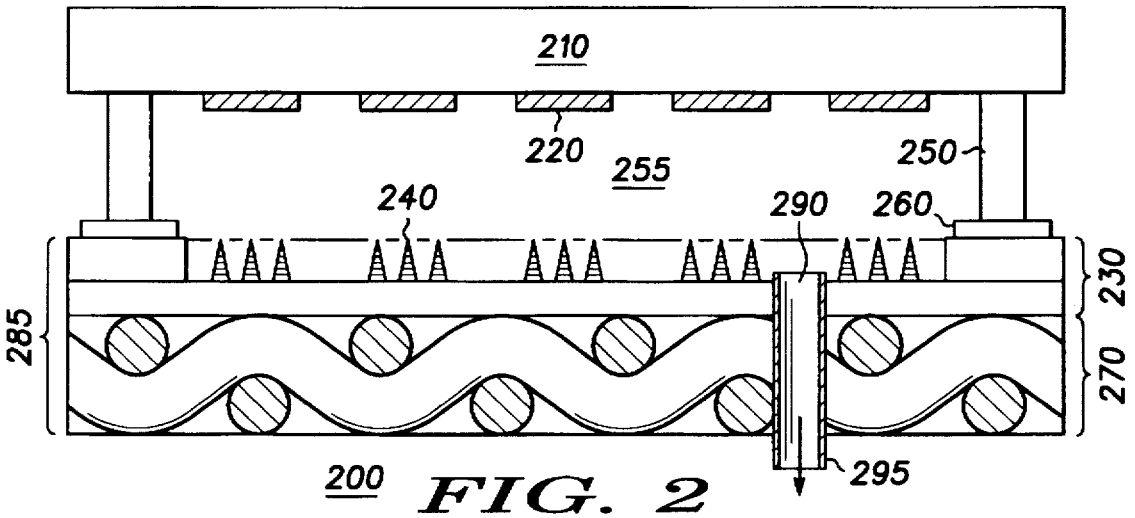
200 FIG. 2
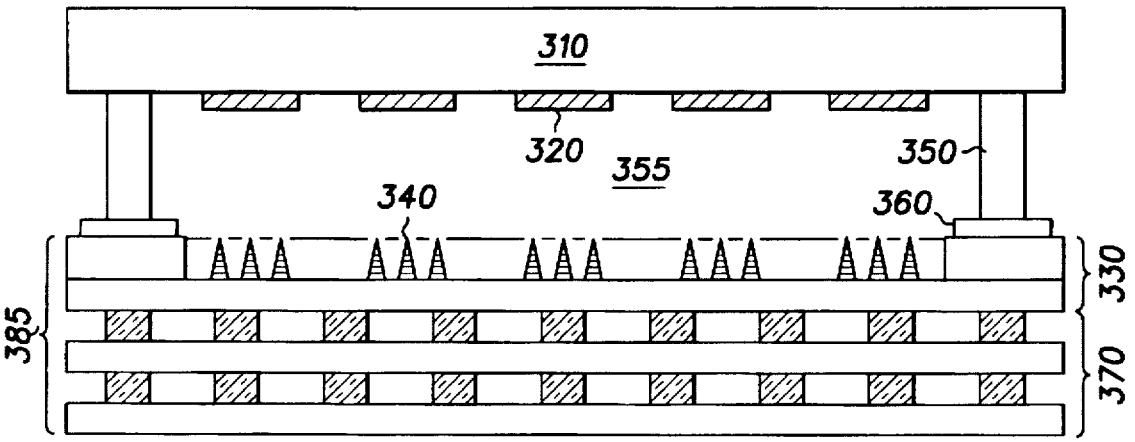
300 FIG. 3

FIELD EMISSION DISPLAY HAVING A CATHODE REINFORCEMENT MEMBER

FIELD OF THE INVENTION

The present invention pertains to a field emission display, a method of making a field emission display, and, more specifically, to a field emission display having a cathode reinforcement member.

BACKGROUND OF THE INVENTION

Field emission displays are known in the art. To achieve low weight, the front and back panels (anode and cathode, respectively) of the display include thin substrates which are typically made from glass on the order of 1.1 millimeters thick. As the displays achieve larger sizes, the front and back panels are not thick enough to provide enough structural support to maintain the planarity of the device. Since a vacuum is provided between the panels, this may result in the implosion and destruction of the device.

Several schemes have been proposed for maintaining the structural integrity of thin, flat panel displays. In one such prior art scheme, a plurality of structural spacers are disposed throughout the interior of the device, to provide standoff between the panels. These prior art spacers include structures such as posts, glass spheres, and woven fibers. However, the inclusion of spacers adds complexity to the display fabrication process which, in some instances, is not feasible or cost effective. Spacers also limit other design variables due to the finite volume which they occupy within the display. Spacers in a field emission display impose a lower limit on the spacing between the cathodoluminescent deposits on the front plate (anode or face plate), thereby limiting the resolution of the display.

Certain applications for field emission devices do not require low weight and are, instead, constrained by cost and resolution. In these applications, thick substrates for the anode and cathode are tolerable, while the high cost of including spacers is not. Current processes for fabricating the anode are readily adaptable to different substrate thicknesses. However, the equipment typically employed in the fabrication of the cathode are not readily adaptable to variation in substrate thickness. They are also very expensive so that having different sets of equipment for varying substrate thicknesses is simply not cost effective.

Thus, there exists a need for a method for making field emission displays of varying back panel thicknesses which is cost effective and simple to employ.

BRIEF DESCRIPTION OF THE DRAWINGS

Referring to the drawings:

FIG. 1 is a cross-sectional view of an embodiment of a field emission display in accordance with the present invention.

FIG. 2 is a cross-sectional view of another embodiment of a field emission display in accordance with the present invention.

FIG. 3 is a cross-sectional view of another embodiment of a field emission display in accordance with the present invention.

DESCRIPTION OF THE PREFERRED EMBODIMENT

Referring now to FIG. 1, there is depicted a cross-sectional view of an embodiment of a field emission display (FED) 100 in accordance with the present invention. FED 100 includes an anode 110, a back plate 185, a plurality of electrical signal leads 160, and a plurality of side members 150, which are disposed between anode 110 and back plate 185. Anode 110 includes a plurality of cathodoluminescent deposits 120, which are formed on the inner surface of anode 110. Back plate 185 includes a cathode 130, having inner and outer surfaces, and a cathode reinforcement member 170. Cathode 130 has a plurality of field emitters 140 which are disposed on the inner surface of cathode 130. The inner surface of anode 110 is spaced apart from and opposes the inner surface of cathode 130. Side members 150 maintain this spacing between anode 110 and cathode 130 and are hermetically affixed thereto. Anode 110, cathode 130, and side members 150 define an interspace region 155, which is evacuated to provide a vacuum of about $1\times10^{-6}$ Torr or less. Electrical signal leads 160 are disposed between side members 150 and cathode 130 and are operably connected to external circuitry (not shown) to power or energize the display. Cathode reinforcement member 170 has a major surface which is affixed to the outer surface of cathode 130. It is critical that cathode reinforcement member 170 have a thermal expansion coefficient substantially equal to the thermal expansion coefficient of cathode 130 so that the two structures expand and contract at similar rates during heating and cooling cycles, respectively, during the fabrication of FED 100, thereby avoiding breakage or cracking. The material comprising cathode reinforcement member 170 need not be the same as the material comprising cathode 130, however, and it also need not be transparent. Cathode 130 includes a substrate made from glass so that suitable materials for use in cathode reinforcement member 170 include glass, titanium, or nickel-iron alloys. In this particular embodiment cathode reinforcement member 170 includes a solid plate of glass having a major surface which is affixed to the outer surface of cathode 130. The affixation is accomplished by using a bonding agent 180. A suitable material for bonding agent 180 includes glass frit or a thin layer of aluminum which is anodically bonded to the outer surface of cathode 130 and to the major surface of cathode reinforcement member 170. The layer of aluminum acts as a Faraday shield which isolates field emitters 140 from electronic noise originating from the electronics that power FED 100. Cathode 130 is first fabricated by processes known to one skilled in the art. These processes utilize expensive substrate processing equipment, such as steppers and etchers, which do not easily accommodate variable cathode substrate thicknesses. Additionally, it is desirable to avoid frequent adjustments of the settings of cathode fabrication equipment to ensure the reproducibility of cathode properties. After cathode 130 is made, cathode reinforcement member 170 is affixed to the outer surface of cathode 130. The standard processes for fabricating an anode (face plate or screen) for a display are, in contrast, readily adaptable to variation in substrate thickness. So, the desired thickness of anode 110 is provided by selecting a glass plate substrate having the desired overall thickness. Back plate 185 and anode 110 have thicknesses which are sufficient to provide structural support to maintain the mechanical integrity of FED 100 and thereby obviate the need for structural spacers within the active region of FED 100. For example, a field emission display having a diagonal of 6 inches requires an anode and a back plate each having a thickness of about one quarter inch; a FED having a 14-inch diagonal requires an anode and back plate each having a thickness of about one half inch; and a FED having a 21-inch diagonal requires an anode and back plate each having a thickness of about three quarters of an inch. These thickness are for anodes and back plates made from glass. The appropriate thickness of back plate 185 depends on the mechanical properties of the material and structure comprising cathode reinforcement member 170. Cathode 130 has a constant thickness, independent of the length of the diagonal of FED 100, which is determined by the cathode processing technology utilized. This constant thickness of cathode 130 is about 1 millimeter.

Referring now to FIG. 2, there is depicted a cross-sectional view of another embodiment of a field emission display (FED) 200 in accordance with the present invention. FED 200 includes an anode 210, a back plate 285, a plurality of electrical signal leads 260, and a plurality of side members 250, which are disposed between anode 210 and back plate 285. Anode 210 includes a plurality of cathodoluminescent deposits 220, which are formed on the inner surface of anode 210. Back plate 285 includes a cathode 230, having inner and outer surfaces, and a cathode reinforcement member 270. Cathode 230 has a plurality of field emitters 240 which are disposed on the inner surface of cathode 230. The inner surface of anode 210 is spaced apart from and opposes the inner surface of cathode 230. Side members 250 maintain this spacing between anode 210 and cathode 230 and are hermetically affixed thereto. Anode 210, cathode 230, and side members 250 define an interspace region 255, which is evacuated to provide a vacuum of about $1\times10^{-6}$ Torr or less. Electrical signal leads 260 are disposed between side members 250 and cathode 230 and are operably connected to external circuitry (not shown) to power or energize the display. Cathode reinforcement member 270 has a major surface which is affixed to the outer surface of cathode 230. It is critical that cathode reinforcement member 270 have a thermal expansion coefficient substantially equal to the thermal expansion coefficient of cathode 230 so that the two structures expand and contract at similar rates during heating and cooling cycles, respectively, during the fabrication of FED 200, thereby avoiding breakage or cracking. Cathode 230 includes a substrate made from glass. In this particular embodiment, cathode reinforcement member 270 includes a webbed structure which is made from a suitable material such as glass or a suitable metallic material such as titanium or a nickel-iron alloy. In this particular embodiment, cathode reinforcement member 270 includes a stack of lattices adhered together to form a three-dimensional latticework. Each lattice includes a plurality of filaments being interwoven in a warp and weft fashion, such as is used in clothing fabric. In this particular embodiment, the filaments include glass threads or fibers, which can be obtained from Owens-Corning Fiberglass Corporation or Pittsburgh Plate Glass Incorporated. The stack of lattices is then coated with a glass cement having a thermal expansion coefficient closely matched to that of the filaments, such as a glass frit having a thermal expansion coefficient substantially equal to that of the glass thread. The coated stack of lattices is then cured in an oven at a suitable temperature, thereby adhering together the lattices and rigidifying the structure to provide cathode reinforcement member 270. In other embodiments of the present invention, the webbed structure is made from other suitable materials, such as suitable metals, and the constituent fibers, threads, or fibers are adhered together by other suitable adhesion methods. Cathode reinforcement member 270 has a major surface which is affixed to the outer surface of cathode 230 by, for example, using a suitable adhesive, such as glass frit. FED 200 further includes an exhausting tube 295 which is disposed in a hole 290 defined by cathode reinforcement member 270 and cathode 230. Exhausting tube 295 is used during the evacuation of interspace region 255 by operably coupling exhausting tube 295 to a suitable vacuum pump (not shown).

Referring now to FIG. 3, there is depicted a cross-sectional view of another embodiment of a field emission display (FED) 300 in accordance with the present invention. FED 300 includes an anode 310, a back plate 385, a plurality of electrical signal leads 360, and a plurality of side members 350, which are disposed between anode 310 and back plate 385. Anode 310 includes a plurality of cathodoluminescent deposits 320, which are formed on the inner surface of anode 310. Back plate 385 includes a cathode 330, having inner and outer surfaces, and a cathode reinforcement member 370. Cathode 330 has a plurality of field emitters 340 which are disposed on the inner surface of cathode 330. The inner surface of anode 310 is spaced apart from and opposes the inner surface of cathode 330. Side members 350 maintain this spacing between anode 310 and cathode 330 and are hermetically affixed thereto. Anode 310, cathode 330, and side members 350 define an interspace region 355, which is evacuated to provide a vacuum of about $1\times10^{-6}$ Torr or less. Electrical signal leads 360 are disposed between side members 350 and cathode 330 and are operably connected to external circuitry (not shown) to power or energize the display. Cathode reinforcement member 370 has a major surface which is affixed to the outer surface of cathode 330. It is critical that cathode reinforcement member 370 have a thermal expansion coefficient substantially equal to the thermal expansion coefficient of cathode 330 so that the two structures expand and contract at similar rates during heating and cooling cycles, respectively, during the fabrication of FED 200, thereby avoiding breakage or cracking. Cathode 330 includes a substrate made from glass. In this particular embodiment, cathode reinforcement member 370 includes a column-shaped structure including a plurality of rods or filaments made from a suitable material, such as glass or a suitable metallic material such as titanium or a nickel-iron alloy. The column-shaped structure can also be formed from a plurality of plates of glass into which grooves have been cut to provide the recessed portions of the structure. The grooves are formed with a diamond saw or other suitable glass-cutting equipment. The plurality of plates of glass are then stacked and adhered together with a suitable adhesive, such as a glass frit having a thermal expansion coefficient substantially equal to that of the glass. The open structure of cathode reinforcement member 370 provides the additional benefit of reduced weight, while providing adequate strength. Cathode reinforcement member 370 has a major surface which is affixed to the outer surface of cathode 330 by, for example, using a suitable adhesive, such as glass frit. The thickness of cathode reinforcement member 370 is sufficient to maintain the mechanical integrity of FED 300 and preclude implosion due to atmospheric pressure. This thickness is determined by the overall size of FED 300 and further obviates the need for internal spacer support.

Other suitable structures for use in the cathode reinforcement member in accordance with the present invention will be readily apparent to one skilled in the art.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. A field emission device comprising:

a cathode including a substrate having first and second major surfaces and having a plurality of field emitters in the first major surface, the cathode having a thickness that alone is insufficient to prevent implosion of the cathode and further having a thermal expansion coefficient;

a cathode reinforcement member having a major surface affixed to the second major surface of the substrate of the cathode, the cathode reinforcement member having a thermal expansion coefficient substantially equal to the thermal expansion coefficient of the cathode and further having a thickness sufficient to prevent implosion of the cathode, wherein the cathode reinforcement member includes a metallic web; and an anode disposed to receive electrons emitted by the plurality of field emitters of the cathode.

2. A field emission device comprising:

a cathode including a substrate having first and second major surfaces and having a plurality of field emitters in the first major surface, the cathode having a thickness that alone is insufficient to prevent implosion of the cathode and further having a thermal expansion coefficient;

a cathode reinforcement member having a major surface affixed to the second major surface of the substrate of the cathode, the cathode reinforcement member having a thermal expansion coefficient substantially equal to the thermal expansion coefficient of the cathode and further having a thickness sufficient to prevent implosion of the cathode, wherein the cathode reinforcement member is made from titanium; and an anode disposed to receive electrons emitted by the plurality of field emitters of the cathode.

* * * * *